US005806944A

United States Patent [19]

Greenfield

[11] Patent Number: 5,806,944

[45] Date of Patent: Sep. 15, 1998

[54] PORTABLE DINING WARE CABINET

[76] Inventor: Stewart H. Greenfield, 18567 W. Sterling Ct., Grayslake, Ill. 60030

[21] Appl. No.: 746,245

[22] Filed: Nov. 7, 1996

[51] Int. Cl.[6] ..... A47B 95/02

[52] U.S. Cl. ..... 312/244; 190/12 R

[58] Field of Search ..... 190/12 R; 206/500, 206/501, 502, 514, 541, 585, 592, 499; 220/912, DIG. 10; 312/209, 244, 237, 351, 352

[56] References Cited

U.S. PATENT DOCUMENTS

| | | | |
|---|---|---|---|
| 46,415 | 2/1865 | Woods . | |
| 815,592 | 3/1906 | Karlson . | |
| 1,413,136 | 4/1922 | Schmitt | 190/12 R |
| 1,955,203 | 4/1934 | Salomon . | |
| 1,985,412 | 12/1934 | Jackson . | |
| 2,254,431 | 9/1941 | Levine . | |
| 2,739,863 | 3/1956 | Ferris . | |
| 2,999,583 | 9/1961 | Mancini . | |
| 3,338,651 | 8/1967 | Jacobson . | |
| 3,365,260 | 1/1968 | Saxon . | |
| 3,452,878 | 7/1969 | Smith . | |
| 3,984,162 | 10/1976 | Zozzaro . | |
| 4,586,762 | 5/1986 | Kennedy et al. . | |

*Primary Examiner*—Peter M. Cuomo
*Assistant Examiner*—Gerald A. Anderson
*Attorney, Agent, or Firm*—Brinks Hoffer Gilson & Lione

[57] ABSTRACT

A portable dining ware cabinet having a front opening for gaining access to the interior of the cabinet. Inside the cabinet is a dishware compartment designed for storing dishes in spaced, non-contacting relation, a glassware compartment for storing glasses in spaced, non-contacting relation and a plurality of additional storage compartments for storing additional items. The cabinet has a door at the front opening, and when the door is closed, the items stored within the cabinet are substantially immobilized and inaccessible.

8 Claims, 2 Drawing Sheets

PORTABLE DINING WARE CABINET

BACKGROUND OF THE INVENTION

This invention relates to a portable dining ware cabinet which can be used on camping trips, picnics and other events where dining ware is needed but not readily at hand, such as at office functions.

At such events, it is desirable to have plates, dishes, utensils and other dining accessories. However, portable units of the prior art typically have not been able to both maintain these items in a convenient storage area while not in use, and transport them in a secure manner, without having to pack and repack them for use and transportation. For example, in U.S. Pat. No. 3,984,162, the utility wagon has a generally planar shelf member, but the items stored on that member are not secured in position on the shelf. A similar problem exists with U.S. Pat. No. 1,985,412. Accordingly, it is a primary object of this invention to develop an improved dining ware cabinet which overcomes these drawbacks or deficiencies in the prior art.

SUMMARY OF THE INVENTION

In accordance with the primary object of this invention, there is disclosed a portable dining ware cabinet comprising a housing with a front opening, and a door covering the front opening. Upon opening the door, the user gains access to the interior of the cabinet. Inside the cabinet are a plurality of compartments for securely holding dishware and glassware in non-contacting relation. In addition, the interior of the housing may include adjustable shelving designed to hold larger cooking and dining accessories in place, and store additional items such as condiments, paper goods and wrapping material. The housing is constructed so that it is easy to transport. It is also designed so that the contents are secured within the cabinet during transport.

One of the primary aspects of the present invention is that it provides a convenient means of storing and transporting dining ware in a portable cabinet. The present invention also provides a means of securely storing the dining ware during transport. Still another aspect of this invention is that it provides custom designed dining ware which is functional and securable in the cabinet.

BRIEF DESCRIPTION OF THE DRAWINGS

The invention summarized above is illustrated in the accompanying drawings in which.

DETAILED DESCRIPTION OF THE DRAWINGS

Figure 1:
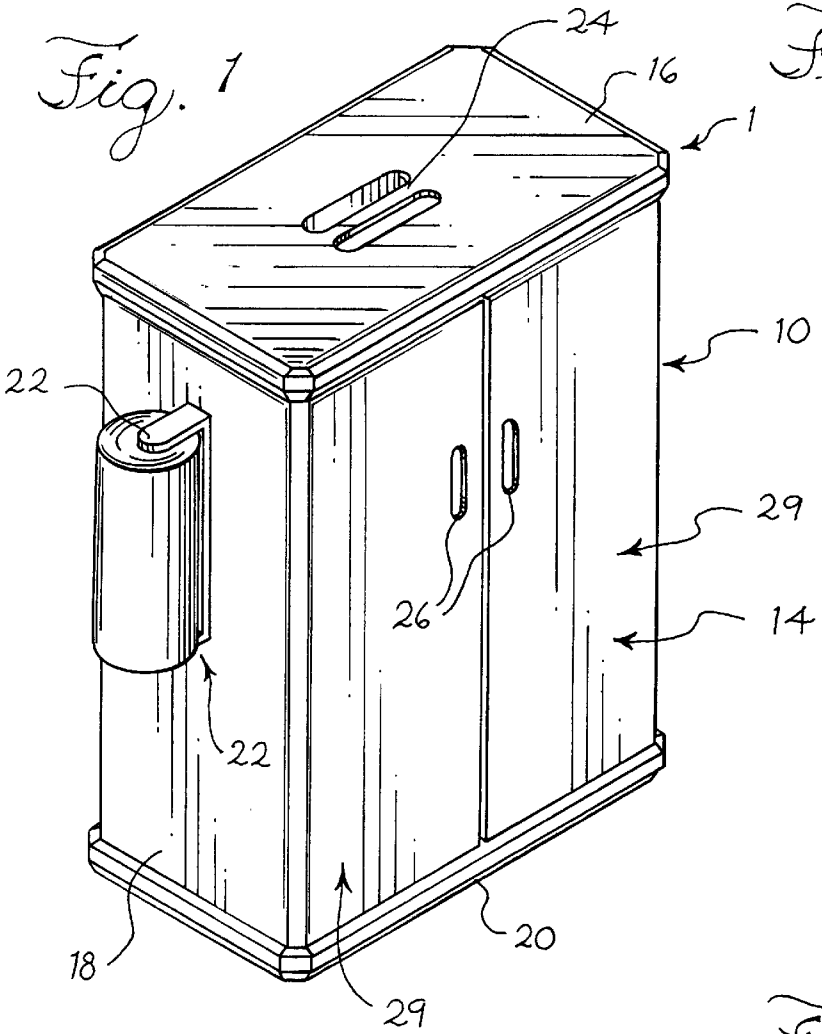
FIG. 1 is an elevation of a preferred embodiment of this invention.
Figures 2, 3, 4:
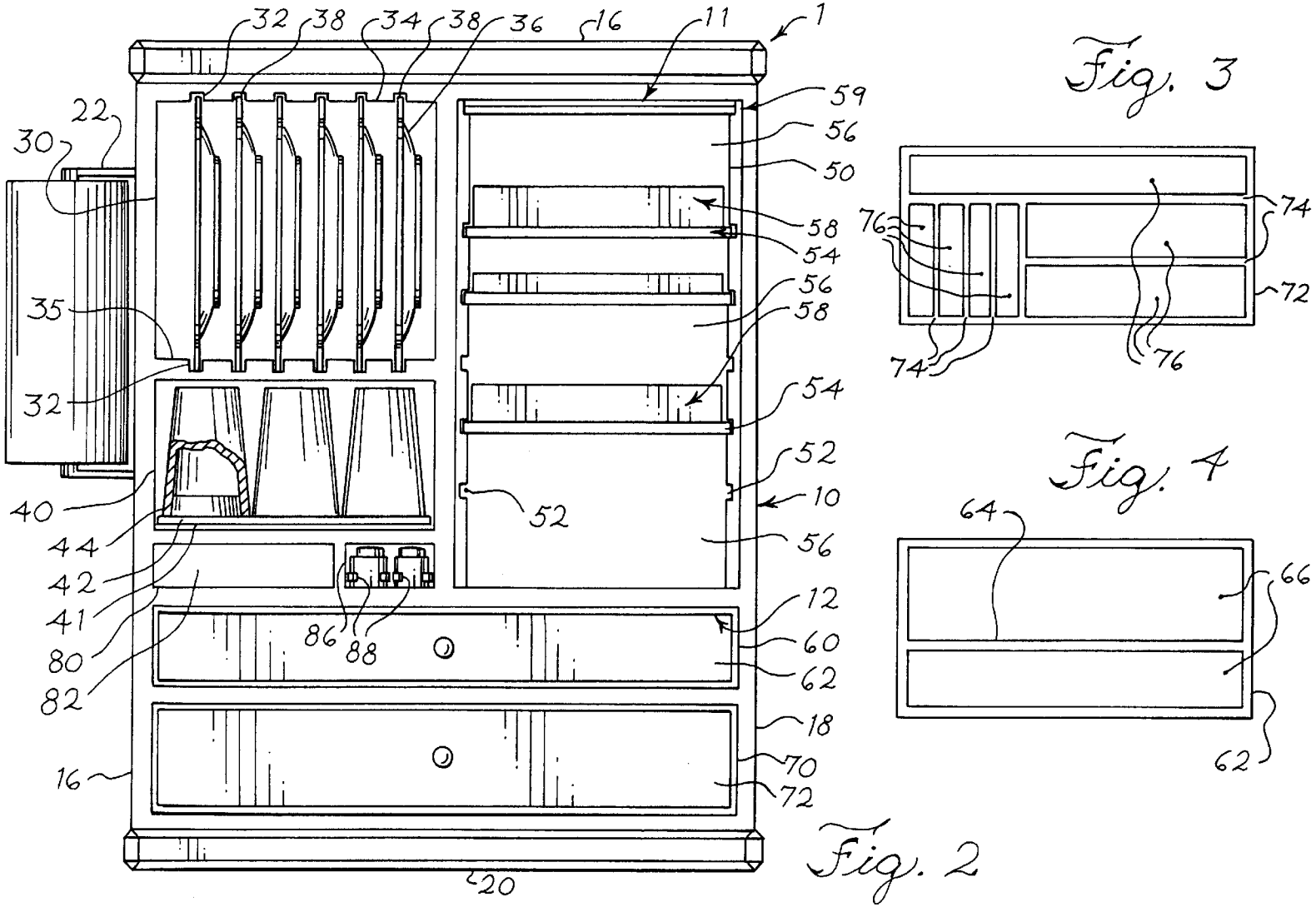
FIG. 2 is an elevation of the interior of a preferred embodiment with the door removed.
FIG. 3 is the top plan view of a preferred embodiment of the interior of the drawer for storing cooking supplies depicted in FIG. 2.
FIG. 4 is the top plan view of a preferred embodiment of the interior of the drawer for storing silverware and utensils depicted in FIG. 2.

Referring now to the drawings, FIGS. 1 and 2 depict a portable cabinet 1 having a housing 10. Housing 10 is characterized by a front opening 12, a closed top portion 16, two closed side portions 18 and a closed base portion 20. Covering the front opening 12 is a door 14, preferably hinged to one of said side portions 18 of the housing 10.

In the preferred embodiment shown in FIG. 1, the door 14 has two door panels 29 that open in the center of the cabinet 1. The door panels 29 are hinged to the side portions 18 of the housing 10. Preferably, a conventional spring loaded press release lock system is included for securing the door in a closed position during transportation and storage. However, other means are also available for securing the door, including a latch or conventional lock. When the door is in the closed position it keeps the contents stored inside the cabinet in place and prevents them from falling out of the cabinet.

On the exterior of the top portion 16 of the housing 10 is a handle 24 for lifting and carrying the cabinet. Preferably, this handle 24 is flush molded to provide the cabinet with a smooth exterior surface. However, a conventional handle or handles may also be used.

On the door 14, or door panels 29, is an indented molded hand pull 26. A indented molded handle pull 26 is preferred to provide the cabinet 1 with a smooth exterior finish. However, conventional door handles are also acceptable. In some cases, the locking means on the door may also serve as an opening means. In that event, no handles may be needed.

In addition to the above features, the preferred embodiment of the invention depicted in FIG. 1 has a towel rack 22 installed on the exterior of one of said side portions 18 of the housing 10 for holding rolls of paper towels without taking up space in the interior 11 of the housing 10.

Preferably the cabinet 1 and all of its constituent parts are made out of a lightweight, plastic material, selected for its durability and for its weight. Other lightweight materials are also acceptable, including metal and wood. These alternative materials can be used to make the cabinet and/or all or some of its constituent parts.

The interior 11 of the housing 10 has multiple compartments and drawers for storing dining ware and accessories. A first compartment 30 preferably has a plurality of pairs of grooves 32 evenly spaced on parallel, opposing sides of the first compartment 30. In the embodiment shown in FIG. 2, these grooves 32 are horizontally spaced on the top and bottom interior sides (34, 35) of the first compartment 30 for securing a plurality of plates 36 within pairs of the parallel, opposing grooves 32. The diameter of the plate 36 is designed so that the outer edges 38 of the plate 36 fit securely within a pair of the parallel, opposing grooves 32.

Figure 5:
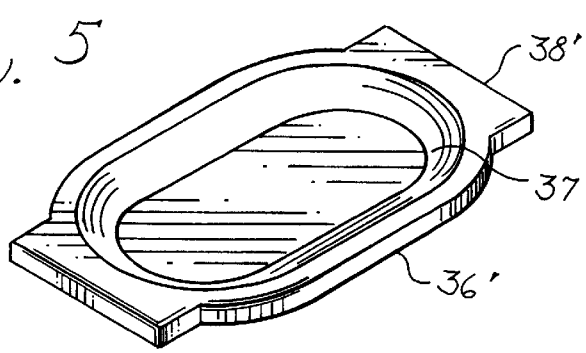
FIG. 5 is a detailed view of a plate designed to be securely stored in the interior of the embodiment of FIG. 2.

In one embodiment of the cabinet 1, a plate 36' is designed so that it can function as a plate and a tray, and still be a convenient shape for storage in the grooved first compartment 30. In this embodiment, as shown in FIG. 5, the plate 36' is substantially rectangular in shape with two parallel squared edges 38' that fit snugly within the a pair of the parallel, opposing grooves 32. The center of this plate 36' is an oval-shaped indentation 37 which serves as the plate portion. The squared edges 38' extend outwardly from the indentation 37 and serve as handles so that the plate 36' also functions as a tray. While the use of plate 36' is preferred, any plate with a sufficient diameter to engage a pair of the parallel, opposing grooves 32 can be secured in this invention.

In a second compartment 40 for storing glasses, there is a tray 42 slidably secured to the base 41 of the second compartment 40. The tray 42 slides outwardly from the housing 10 for easy access to glasses stored on the tray 42. As depicted in FIG. 2, a plurality of flat, cone-shaped cup sleeves 44 are evenly spaced in the top surface of the tray 42. The diameter of these cup sleeves is only fractionally smaller than the diameter of glasses to be stored on the tray 42. When glasses are inverted and their open end placed over the cup sleeves, the glasses do not accidentally disengage from the cup sleeves during transport. The glasses for use in this invention can be of any material, but preferably plastic for its lightweight and durability.

Figure 7:
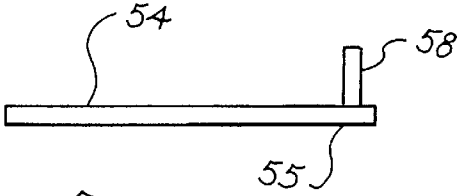
FIG. 7, is a detailed side elevation of a drawer for storing larger items in the embodiment of FIG. 2.

As depicted in FIG. 2, a third compartment 50 has a plurality of parallel, opposing pairs of grooves 52 spaced along the horizontal sides of the third compartment 50. The third compartment 50 is outfitted with a plurality of slidable shelves 54 which can fit into a pair of the parallel, opposing grooves 52 to form cubicles 56 in the compartment 50. The height of the cubicles 56 can be adjusted by fitting the slidable shelves into different pairs of parallel, opposing grooves 52. As depicted in FIG. 7, a lip 58 is positioned perpendicular to the shelf 54 on the edge 55 of the shelf 54 closest the front opening 12. This lip 58 protects items from rolling off the shelf 54 during transport. This cutting board 59 slides into a pair of the parallel, opposing grooves 52. A removable cutting board 59 is also fitted into this compartment 50. Preferably, the cutting board is made of high density polyethelene (HDPE).

In a fourth compartment 60, drawer 62 is inserted. As depicted in FIG. 4, this drawer 62 has a single diving wall 64 positioned in the middle of the drawer 62, to divide the drawer into two sections 66. This drawer 62 is a convenient storage area for plastic wrap, aluminum foil and other nonbreakable items.

In a fifth compartment 70, a drawer 72 is also inserted. This drawer 72 may be identical to or different from the drawer 62 in the fourth compartment 60. As depicted in FIG. 3, the interior of the drawer 72 has a plurality of dividing walls 74. The dividing walls 74 are positioned so that the drawer 72 into sections 76 of varying sizes suitable for storing silverware and cooking utensils.

Figure 6:
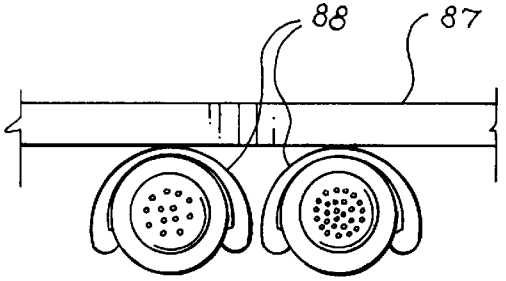
FIG. 6 is a top plan view of the spring clamps used to secure containers.

A sixth compartment 80 and a seventh compartment 86 are also positioned in the interior 11 of the housing 10. This sixth compartment 80 comprises a slot 82 for storing napkins. The seventh compartment 86 is for storing containers, such as salt and pepper shakers or condiment jars. On the rear wall 87 of the seventh compartment 86 is mounted a plurality of spring clamps 88 (FIG. 6) into which the containers are inserted to secure them within the cabinet. Other securing means are also available including rings into which the containers are placed. Alternatively, a railing or bar is added to the compartment and the containers are stored behind the railing or bar.

In an alternative embodiment, the slot 82 for receiving napkins and/or the spring clamps 88 or other securing means for securing the containers can be incorporated into one of the third, fourth or fifth compartment (50, 60, 70). This eliminates the need for separate sixth and seventh compartments (80, 86).

When the door 14 of the cabinet 1 is closed, the door 14 prevents the drawers (62, 72) from opening during transport. It also assists in keeping dishware, glasses and additional items stored in the compartments (30, 40, 50, 80, 86) secured within the cabinet 1.

The arrangement of these compartments within the interior of the housing is preferably positioned as shown in FIG. 2 with the first compartment 30 at the top of the interior of the housing 10. The second compartment 40 is positioned below the first compartment 30, and the sixth and seventh compartments (80, 86) are positioned adjacent each other and below the second compartment 40. Adjacent these compartments is the third compartment 50. The fourth and fifth compartments (60, 70) are positioned below the previously recited compartments. While the positioning of these compartments can obviously be varied, the positions should be such that the cabinet itself remains of a compact design, and preferably the glassware and dishware compartments are positioned in the top half of the cabinet for easier access.

While the embodiment of the invention described above is preferred, numerous modifications, additions and changes may occur to those skilled in the art without departing from the true spirit of the invention. Accordingly, all such modifications, additions and changes are intended to be incorporated in the appended claims.

I claim:

1. A portable, compartmentalized dining ware cabinet comprising:

a housing having a front opening;

a door at said front opening for gaining access to the interior of said housing;

a dishware compartment within said housing, wherein said dishware compartment further comprises a plurality of pairs of parallel grooves on opposing walls of said dishware compartment for slidably receiving and positioning a plurality of dishes in spaced, noncontacting relation;

a glassware compartment within said housing, wherein said glassware compartment further comprises a tray slidably engaged on the base portion of said glassware compartment, and a plurality of flat, conical-shaped cup sleeves, evenly spaced on said tray for receiving and positioning a plurality of drinking glasses in spaced, non-contacting relation;

a plurality of additional storage compartments within said housing for storing additional items, wherein at least one of said plurality of additional storage compartments further comprises a drawer slidably received in within said at least one storage compartment, and at least one divider disposed within said drawer for dividing said drawer into sections and where at least a second of said plurality of additional storage compartments further comprises a plurality of pairs of grooves evenly spaced on parallel opposing sides of said at second storage compartment, and at least one shelf removably engaged within a pair of said parallel, opposing grooves; and means for selectively securing said door in a closed position, whereby said dishes, glasses and additional items are accessible when said door is opened and substantially immobilized and inaccessible when said door is closed.

2. The cabinet of claim 1, wherein the dish to be received within said dishware compartment, further comprises a substantially rectangular eating surface, substantially straight edges on two opposing sides of said surface, wherein the distance between said straight edges is of sufficient length to engage said edges within a pair of said parallel, opposing grooves of said dishware compartment.

3. The cabinet of claim 1, wherein means for receiving and retaining a container is positioned on a wall of at least one of said plurality of additional storage compartments.

4. The cabinet of claim 1, wherein the means for receiving and retaining a container is a spring clamp.

5. The cabinet of claim 1, wherein the cabinet further comprises a locking means for selectively securing the door in a closed position.

6. The cabinet of claim 5, wherein the locking means is a spring loaded press release lock system.

7. The cabinet of claim 1, wherein the cabinet further comprises at least one handle for lifting and carrying the cabinet.

8. The cabinet of claim 1, wherein a cutting board is removably secured within a pair of grooves of said additional storage compartment having a plurality of pairs of evenly spaced grooves on opposing sides of said compartment.

* * * * *